US010907781B2

(12) United States Patent
Shao

(10) Patent No.: US 10,907,781 B2
(45) Date of Patent: Feb. 2, 2021

(54) LED DECORATIVE LIGHTING ASSEMBLY HAVING TWO PARALLEL CONDUCTORS AND AN INSULATING PORTION ENCAPSULATING PORTIONS OF THE CONDUCTORS AND A SPACE THERE BETWEEN

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/846,784

(22) Filed: Apr. 13, 2020

(65) Prior Publication Data

US 2020/0240599 A1 Jul. 30, 2020

Related U.S. Application Data

(63) Continuation-in-part of application No. 16/298,935, filed on Mar. 11, 2019.
(Continued)

(30) Foreign Application Priority Data

Mar. 9, 2018 (CN) ..... 2018 1 0195592

(51) Int. Cl.
*F21S 4/22* (2016.01)
*F21V 9/08* (2018.01)
(Continued)

(52) U.S. Cl.
CPC ..... *F21S 4/22* (2016.01); *F21V 9/08* (2013.01); *F21V 23/02* (2013.01); *F21Y 2115/10* (2016.08)

(58) Field of Classification Search
CPC ..... F21S 4/00; F21S 4/10; F21S 4/20; F21S 4/22; F21S 4/24; F21S 4/26; F21S 4/28; F21Y 2115/10
See application file for complete search history.

(56) References Cited

U.S. PATENT DOCUMENTS 4,379,609 A 4/1983 Hardesty
4,438,998 A 3/1984 Myers
(Continued)

FOREIGN PATENT DOCUMENTS

CA 2 655 486 A1 9/2009
CN 200982547 Y 11/2007
(Continued)

OTHER PUBLICATIONS

U.S. Appl. No. 16/573,890, filed Sep. 17, 2019, Inventor Shu Fa Shao.
(Continued)

*Primary Examiner* — Robert J May
(74) *Attorney, Agent, or Firm* — Christensen, Fonder, Dardi & Herbert PLLC

(57) ABSTRACT

A light string defining a lengthwise, central axis, comprising a wire set that includes a first conductor in parallel with a second conductor; and an insulation layer, wherein the insulation layer encapsulates a portion of the first conductor, a portion of the second conductor, and a space therebetween. The insulation layer defines a plurality of gaps such that portions of the first and second conductors are uninsulated. The light string also includes first and second pluralities of LED assemblies in electrical connection with the wire set. Each of the first plurality of LED assemblies is configured to emit light of a first color in a first direction; and each of the second plurality of LED assemblies is configured to emit
(Continued)

light of a second color in a second direction, the second direction being opposite to the first direction.

20 Claims, 2 Drawing Sheets

Related U.S. Application Data

(60) Provisional application No. 62/833,530, filed on Apr. 12, 2019, provisional application No. 62/682,683, filed on Jun. 8, 2018.

(51) Int. Cl.
*F21V 23/02* (2006.01)
*F21Y 115/10* (2016.01)

(56) References Cited

U.S. PATENT DOCUMENTS 4,460,234 A 7/1984 Bogese
4,593,966 A 6/1986 Meyer
4,675,575 A 6/1987 Smith et al.
4,761,720 A 8/1988 Solow
4,812,956 A 3/1989 Chen
4,895,532 A 1/1990 Bogese, II
4,908,743 A 3/1990 Miller
5,106,306 A 4/1992 Ditzig
5,109,324 A 4/1992 Ahroni
5,150,964 A 9/1992 Tsui
5,245,519 A 9/1993 Openiano
5,454,737 A 10/1995 Saba
5,645,342 A 7/1997 Chang
5,697,815 A 12/1997 Drewnicki
5,747,940 A 5/1998 Openiano
5,834,901 A 11/1998 Shen
5,975,717 A 11/1999 Rahman
6,042,418 A 3/2000 Cummings
6,086,221 A 7/2000 Wu
6,086,222 A 7/2000 Juba
6,091,204 A 7/2000 Chen
6,113,432 A 9/2000 Liao
6,146,207 A 11/2000 Mulot
6,367,952 B1 4/2002 Gibboney, Jr.
6,582,094 B2 6/2003 Liu
6,592,238 B2 7/2003 Cleaver et al.
6,604,841 B2 8/2003 Liu
6,609,814 B2 8/2003 Ahroni
6,777,891 B2 8/2004 Lys et al.
6,914,194 B2 7/2005 Fan
7,048,550 B2 5/2006 Hyland et al.
7,062,442 B2 6/2006 Sugar
7,088,904 B2 8/2006 Ryan, Jr.
7,131,748 B2 11/2006 Kazar et al.
7,160,140 B1 1/2007 Mrakovich et al.
7,186,005 B2 3/2007 Hulse
7,235,815 B2 6/2007 Wang
7,250,730 B1 7/2007 Allen
7,253,566 B2 8/2007 Lys et al.
7,338,327 B2 3/2008 Sticker et al.
7,481,555 B2 1/2009 Huang et al.
7,494,244 B1 2/2009 Van Diep
7,554,266 B1 6/2009 Chen
7,569,996 B2 8/2009 Holmes
7,784,961 B1 8/2010 Rawlings
7,905,753 B2 3/2011 Siev et al.
7,926,978 B2 4/2011 Tsai
7,976,191 B2 7/2011 Gibboney
8,076,872 B2 12/2011 Sauerlander
8,203,275 B2 6/2012 Ruxton
8,371,716 B2 * 2/2013 Shen ..... F21S 4/26 362/249.02
8,397,381 B2 3/2013 Tsai
8,454,186 B2 6/2013 Chen
8,454,187 B2 6/2013 Chen
8,469,734 B2 6/2013 Chen
8,469,750 B2 6/2013 Chen
8,480,278 B2 7/2013 Wasem
8,562,175 B2 10/2013 Chen
8,568,015 B2 10/2013 Chen
8,569,960 B2 10/2013 Chen
8,592,845 B2 11/2013 Chen
8,598,805 B2 12/2013 Tremblay
8,608,342 B2 12/2013 Chen
8,622,576 B2 1/2014 Zhan
8,641,229 B2 2/2014 Li
8,680,773 B2 3/2014 Hering et al.
8,876,321 B2 11/2014 Chen
8,974,072 B2 3/2015 Chen
9,044,056 B2 6/2015 Chen
9,055,777 B2 6/2015 Chen
9,060,409 B2 6/2015 Bowers et al.
9,066,617 B2 6/2015 Chen
9,157,587 B2 10/2015 Chen
9,166,323 B2 10/2015 Lampert et al.
9,179,793 B2 11/2015 Chen
9,220,361 B1 12/2015 Chen
9,222,656 B2 12/2015 Chen
9,279,551 B2 3/2016 Vissenberg et al.
9,291,318 B1 3/2016 Benson
9,318,840 B2 4/2016 Siev et al.
9,386,652 B1 7/2016 Lee
9,439,528 B2 9/2016 Chen
9,441,800 B1 9/2016 Chen
9,441,823 B1 9/2016 Chen
9,468,062 B2 10/2016 Rybicki
9,526,286 B2 12/2016 Chen
9,572,446 B2 2/2017 Chen
9,593,831 B2 3/2017 Chen
9,763,298 B2 3/2017 Yu
9,648,919 B2 5/2017 Chen
9,655,211 B2 5/2017 Altamura et al.
9,671,074 B2 6/2017 Chen
9,677,748 B1 6/2017 Chen
9,677,749 B2 6/2017 Chen
9,788,384 B1 10/2017 Harris
9,845,925 B2 12/2017 Chen
9,883,566 B1 1/2018 Chen
9,899,765 B2 2/2018 Wagner
9,907,136 B2 2/2018 Leung et al.
9,939,117 B1 4/2018 Peng
10,006,596 B2 6/2018 Yu et al.
10,103,493 B2 10/2018 Siev et al.
10,123,387 B2 11/2018 Lai
10,136,497 B2 11/2018 Harris
10,178,887 B1 1/2019 Chen
10,184,654 B1 1/2019 Chen
10,205,073 B2 2/2019 Altamura
10,288,235 B1 5/2019 Chen
10,288,236 B1 5/2019 Chen
10,578,260 B1 3/2020 Chen
10,624,166 B1 4/2020 Shao
10,697,598 B1 6/2020 Chen et al.
2002/0027778 A1 3/2002 Ko
2003/0063463 A1 4/2003 Sloan et al.
2004/0012950 A1 1/2004 Pan
2004/0080281 A1 4/2004 **Pan
2004/0090770 A1 5/2004 Primeau
2004/0096596 A1 5/2004 Palmer, III et al.
2004/0165384 A1 8/2004 Allen
2004/0246718 A1 12/2004 Fan
2005/0174065 A1 8/2005 Janning
2006/0158878 A1 7/2006 Howell
2006/0221609 A1 10/2006 Ryan, Jr.
2007/0015396 A1 1/2007 Mrakovich et al.
2007/0177402 A1 8/2007 Wu
2007/0230174 A1 10/2007 Hicks
2007/0262725 A1 11/2007 Koren
2008/0049424 A1 2/2008 Wang
2008/0084695 A1 4/2008 Hsu
2008/0084702 A1 4/2008 Cheung
2008/0094828 A1 4/2008 Shao
2008/0218092 A1 9/2008 Chang et al.
2009/0154156 A1 6/2009 Lo et al.

(56) References Cited

U.S. PATENT DOCUMENTS

| | | | |
|---|---|---|---|
| 2009/0278463 | A1 | 11/2009 | Tang |
| 2009/0302771 | A1 | 12/2009 | Peng |
| 2010/0001664 | A1 | 1/2010 | Shih |
| 2010/0141161 | A1 | 6/2010 | Hering et al. |
| 2010/0157598 | A1 | 6/2010 | Tsai |
| 2010/0277084 | A1 | 11/2010 | Lee |
| 2011/0062875 | A1 | 3/2011 | Altamura |
| 2011/0074300 | A1 | 3/2011 | Hsu |
| 2011/0148311 | A1 | 6/2011 | Neuman |
| 2011/0210677 | A1 | 9/2011 | Hering et al. |
| 2011/0228535 | A1 | 9/2011 | Shao |
| 2011/0305022 | A1 | 12/2011 | Chen |
| 2011/0310601 | A1 | 12/2011 | Shao |
| 2011/0316442 | A1 | 12/2011 | Sako et al. |
| 2012/0007510 | A1 | 1/2012 | Horng |
| 2012/0039070 | A1 | 2/2012 | Shen et al. |
| 2012/0075863 | A1 | 3/2012 | Chen |
| 2012/0275157 | A1 | 11/2012 | Hsu |
| 2013/0078847 | A1 | 3/2013 | Chen |
| 2013/0107514 | A1 | 5/2013 | McNabb et al. |
| 2013/0181232 | A1 | 7/2013 | Jeromerajan |
| 2013/0249394 | A1 | 9/2013 | Fay |
| 2013/0249417 | A1 | 9/2013 | Verlinden |
| 2013/0301246 | A1 | 11/2013 | Chen |
| 2014/0055439 | A1 | 2/2014 | Lee |
| 2014/0179132 | A1 | 6/2014 | Byrne |
| 2014/0268689 | A1 | 9/2014 | Chen |
| 2014/0268818 | A1 | 9/2014 | Huang et al. |
| 2014/0355277 | A1 | 12/2014 | Lin |
| 2015/0008835 | A1 | 1/2015 | Sugiura et al. |
| 2015/0029703 | A1 | 1/2015 | Chen |
| 2015/0070878 | A1 | 3/2015 | Yu |
| 2015/0117001 | A1 | 4/2015 | Fan |
| 2016/0047516 | A1 | 2/2016 | Taylor |
| 2016/0123566 | A1 | 5/2016 | Leung |
| 2016/0183338 | A1 | 6/2016 | Loomis |
| 2016/0186940 | A1 | 6/2016 | Del Castillo et al. |
| 2016/0338171 | A1 | 11/2016 | Bhagat |
| 2016/0341408 | A1 | 11/2016 | Altamura |
| 2017/0023223 | A1 | 1/2017 | Tsai |
| 2017/0038055 | A1 | 2/2017 | Daniels |
| 2017/0055319 | A1 | 2/2017 | Rogers |
| 2017/0108185 | A1 | 4/2017 | He |
| 2017/0295622 | A1 | 10/2017 | Harris |
| 2017/0328527 | A1 | 11/2017 | Yang et al. |
| 2017/0343170 | A1 | 11/2017 | Yu et al. |
| 2018/0020519 | A1 | 1/2018 | Harris |
| 2018/0020520 | A1 | 1/2018 | Harris |
| 2018/0058648 | A1 | 3/2018 | Fang |
| 2018/0073708 | A1 | 3/2018 | Avery et al. |
| 2018/0110101 | A1 | 4/2018 | Kottritsch |
| 2018/0172225 | A1 | 6/2018 | Zhao |
| 2018/0172226 | A1 | 6/2018 | Zhao |
| 2018/0231226 | A1 | 8/2018 | Koo |
| 2018/0299084 | A1 | 10/2018 | Chien |
| 2019/0053348 | A1 | 2/2019 | Harris |
| 2019/0078767 | A1 | 3/2019 | Loomis |
| 2019/0081436 | A1 | 3/2019 | Onodi et al. |
| 2019/0234597 | A1 | 8/2019 | Zhu |
| 2019/0277458 | A1 | 9/2019 | Shao |
| 2019/0335559 | A1 | 10/2019 | Shao |
| 2020/0236746 | A1 | 7/2020 | Shao |

FOREIGN PATENT DOCUMENTS

| | | | |
|---|---|---|---|
| CN | 201121811 | Y | 9/2008 |
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| DE | 3240446 | A1 | 7/1983 |
| EP | 1 172 602 | A1 | 1/2002 |
| GB | 2 454 546 | A | 5/2009 |

OTHER PUBLICATIONS

U.S. Appl. No. 16/298,935, filed Mar. 11, 2019, Inventor Shu Fa Shao.

U.S. Appl. No. 16/219,657, filed Dec. 13, 2018, Inventor Johnny Chen.

U.S. Appl. No. 16/573,880, filed Sep. 17, 2019, Inventor Shu Fa Shao.

U.S. Appl. No. 16/547,377, filed Aug. 21, 2019, Inventor Shu Fa Shao.

* cited by examiner

LED DECORATIVE LIGHTING ASSEMBLY HAVING TWO PARALLEL CONDUCTORS AND AN INSULATING PORTION ENCAPSULATING PORTIONS OF THE CONDUCTORS AND A SPACE THERE BETWEEN

CROSS-REFERENCE TO RELATED APPLICATIONS

This application claims the benefit of U.S. Provisional Patent Application No. 62/833,530, filed Apr. 12, 2019, this application is a Continuation-in-Part of U.S. application Ser. No. 16/298,935, filed Mar. 11, 2019 which claims priority to 62/682,683, filed Jun. 8, 2019, all of which are incorporated herein in their entireties.

FIELD OF THE DISCLOSURE

The present disclosure relates to decorative lighting assemblies. More specifically, the present disclosure relates to a light string including a wire set having a plurality of LED light assemblies disposed along its length.

BACKGROUND

Light strings commonly include a pair of twisted wires with sockets disposed along the length of the light string. Bulbs, generally incandescent bulbs, are inserted into the sockets. The light strings may then be wrapped around objects or suspended to create a decorative lighting effect. For example, some light strings may be wrapped around a tree or plant to create a decorative lighting effect in an outdoor setting. However, it can be time consuming to arrange the bulbs and sockets in a uniform and pleasing manner and twisted pair wires are prone to kinks and tangles. Further, in traditional light strings, the wire is bulky and easily visible. A light string that is not prone to tangle, that minimizes wire and light size, and that has some uniformity to the lights would be well received by the industry.

SUMMARY

A light string in accordance with embodiments has a wire and a plurality of LED assemblies. The wire includes a first conductor in parallel with a second conductor such that an interior edge of the first conductor and an interior edge of the second conductor defines a space there between. An insulation layer encapsulates the first conductor, the second conductor, and the space there between. The insulation layer has a plurality of gaps such that portions of the first and second conductors are uninsulated.

Each of the plurality of LED assemblies has a base or mount having front, back, left, right, top, and bottom sides. An LED is electrically mounted to the front side of the base and a lens cover is affixed to the front side of the base, covering the LED. A first conductive terminal of the bottom of the base is in electrical contact with the first conductor of the wire, and a second conductive terminal of the bottom of the base is in electrical contact with the second conductor of the wire. A first solder portion encapsulates a portion of the left side of the base, the first conductive terminal, and a portion of the first conductor, and a second solder portion encapsulates a portion of the right side of the base, the right conductive terminal, and a portion of the second conductor. In embodiments, first and second solder portions may also contact, partially cover, or partially encapsulate portions of the front side or surface of the base.

In embodiments, the wire may include a second plurality of LED assemblies. Each of the second plurality of LED assemblies may include a base or mount where a first conductive terminal of the bottom of the mount is in electrical contact with the second conductor of the wire, and a second conductive terminal of the bottom of the mount is in electrical contact with the first conductor of the wire.

In embodiments, the wire may be attached to a power plug at one end. In embodiments, the wire may also be attached to a receptacle configured to receive a power plug, at another end. In embodiments, the wire may include a plurality of protective layers. Each of the protective layers can encapsulate a gap and an LED assembly.

In embodiments, the base can extend radially outward a distance greater than the radial distance of an exterior edge of the first conductor. In other embodiments, the base may not extend radially outward a distance greater than the radial distance of the exterior edge of the first conductor, but rather, may extend so as to be at or even with the exterior edge, or may extend such that the base does not reach the exterior edge. The exterior edge of the first conductor is opposite the interior edge. In embodiments, the base extends radially outward a distance greater than the radial distance of an exterior edge of the second conductor. The exterior edge of the second conductor is opposite the interior edge. In embodiments, the lens cover extends radially outward a distance greater than the radial distance of the interior edge of the first conductor. In embodiments, the lens cover extends radially outward a distance greater than the radial distance of the interior edge of the second conductor.

In embodiments, each of the plurality of LED assemblies may include a plurality of LEDs. In embodiments, each of the plurality of the LED assemblies is configured to produce a single color of light. In embodiments, each of the plurality of the LED assembly is configured to produce multiple colors of light.

DETAILED DESCRIPTION

Figure 1:
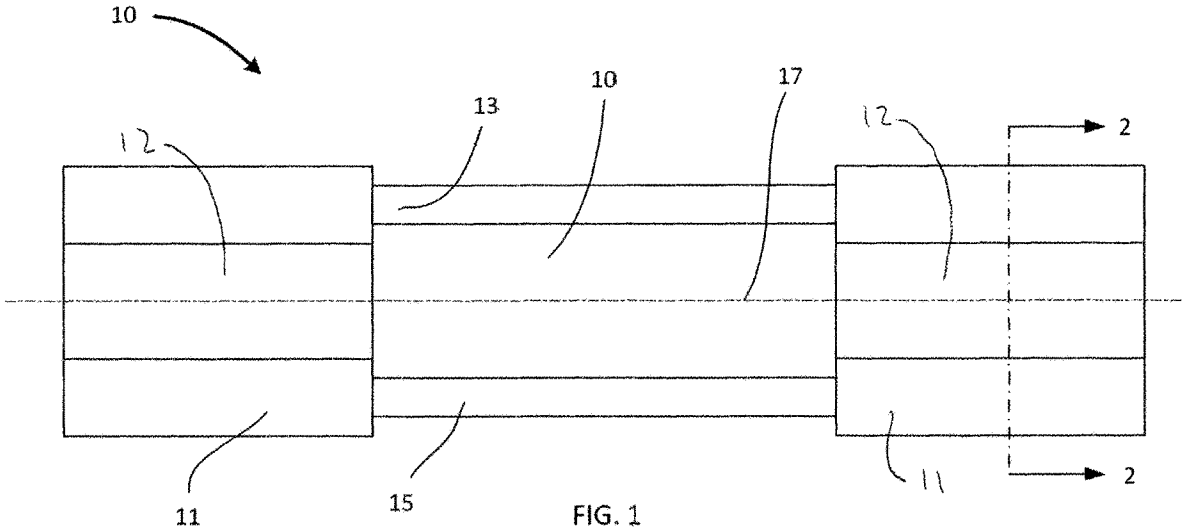
FIG. 1 is a top view of a wire according to an embodiment of the disclosure.

Referring to FIG. 1, a top view of a wire 10 is illustrated having a first conductor 13, a second conductor 15, an insulation layer 11, and central axis 17. Referring also to FIGS. 2-5, first conductor 13 and second conductor 15 are parallel to central axis 17 and define a space between the first and second conductors. Although wire 10 is described as a "wire", it will be understood that wire 10 may be considered a wire system, a wire assembly, a wire set, or even a pair of wires.

Insulation layer 11, which in an embodiment may comprise PVC material, encapsulates first conductor 13, second conductor 15, and the space therebetween in a nonconductive material. As depicted, a substantially flat joining or bridging portion 12 of insulation layer 11 joins insulated conductors 13 and 15, such that the joining portion 12 of insulation layer 11 supports conductors 13 and 15 and creates a separating structure between the conductors. As depicted, the joining portion 12 of insulating layer 11 may be substantially flat and rectangular in cross section, as depicted specifically in FIG. 2. The joining portion of insulation layer 11 causes a predetermined spacing or length L between insulated conductors 13 and 15. The length L may vary depending on a desired separation or spacing of conductors 13 and 15, which may be determined in part by a size of the LED assemblies. 101, as described further below. Length L, in an embodiment is greater than a diameter of conductor 13 or conductor 15. In another embodiment, length L is less than a diameter of conductor 13 or of conductor 15. In embodiments, length L may vary from a length that is approximately one conductor diameter to a length that five conductor diameters. In an embodiment, and as depicted, length L is approximately three conductor diameters.

Wire 10 defines a plurality of gaps 19 where first conductor 13 second conductor 15 are not encapsulated by insulation layer 11. Gaps 19 may facilitate electrical connections with first conductor 13 and second conductor 15.

In an embodiment, first conductor 13 and second conductor 15 may each comprise single-strand conductors (depicted), which may primarily comprise copper. In alternative embodiments, first conductor 13 and second conductor 15 may each comprise multi-strand conductors, such as a 3-strand conductor, 4-strand conductor, and so on. The number of conductive strands for each conductor may be in a range of one conductive strand to eight conductive strands, or even more, depending in some cases on a desired wire size and lighting application. In an embodiment, each conductor 13 and 15 may comprise a relatively small "size" wire have a relatively small cross-sectional area, similar to, or the same as, a 27 AWG wire or conductor, or 0.102 mm2. In some such small-size embodiments, each conductor 13 and 15 may be equivalent to 25 AWG to 28 AWG, depending on the lighting application and resultant expected current flow through the conductors. In other embodiments, conductors 13 and 15 may be larger, similar to a traditional 22 AWG wire size, or in a range of 22 AWG to 25 AWG.

Figure 2:
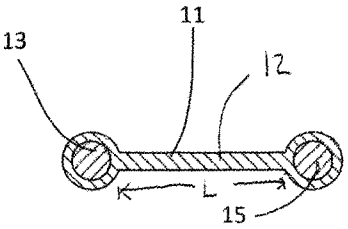
FIG. 2 is a cross sectional view of a wire according to an embodiment of the disclosure.
Figure 3:
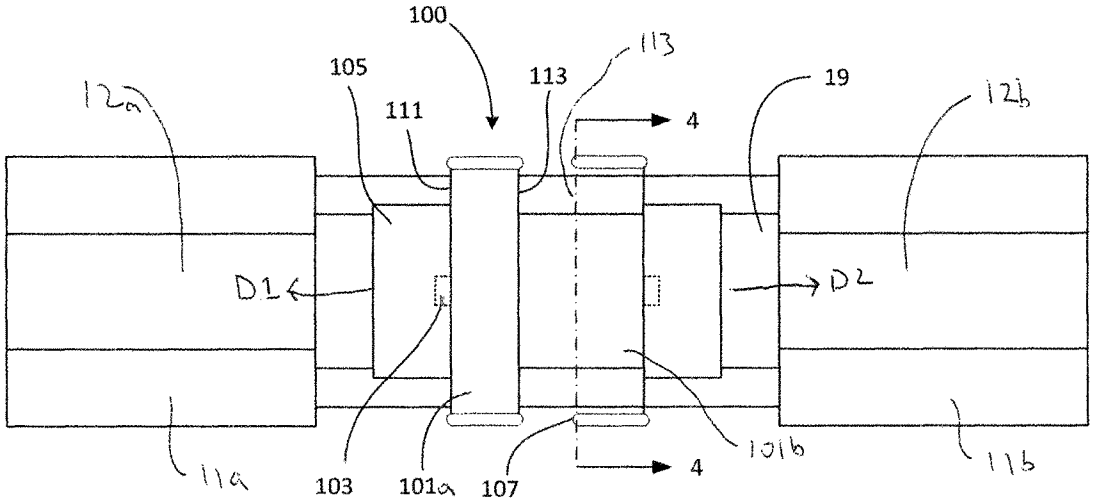
FIG. 3 is a top view of a wire with a plurality of LED assemblies according to an embodiment of the disclosure.
Figure 4:
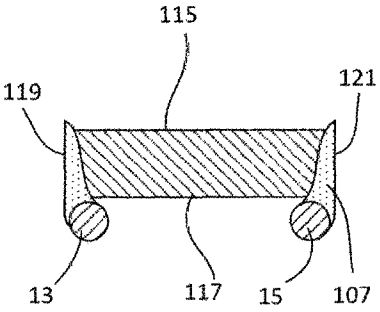
FIG. 4 is a cross sectional view of a wire and LED assembly according to an embodiment of the disclosure.

Referring to FIG. 3, a top view of a wire 10 is illustrated having a plurality of LED assemblies 100 within a gap 19. An LED assembly 101 includes a mount or base 101, a LED 103 capable of emitting light, and a lens cover 105. As shown in FIGS. 2 and 3, mount 101 has a front side 111 opposite a back side 113, a top side 115 opposite a bottom side 117, and a left side 119 opposite a right side 121. Bottom side 117 includes a first electrical contact and a second electrical contact. First and second electrical contacts are configured to allow an electrical connection between conductors 13 and 15 of wire 10 and LED 103, such that each LED assembly 101 and each LED 103 is electrically connected to one another in parallel.

LED 103 is affixed to front side 111 of mount 101. In embodiments, LED 103 may emit monochromatic light. In embodiments, LED 103 may be adapted to emit a plurality of colored lights, such as red, green and blue (RGB). Lens cover 105 is affixed to front side 111 of mount 101. In embodiments, lens cover 105 fully encapsulates LED 103. In embodiments, lens cover 105 is rectangular. In embodiments, lens cover 105 is partially spherical. In embodiments, lens cover 105 is opaque. In embodiments, lens cover 105 is translucent. In embodiments, lens cover 105 is transparent. In embodiments, lens cover 105 is tinted.

LED 103 in an embodiment may be a light-emitting diode mounted to a substrate, thereby forming an LED "chip", and may include other structure, such as connecting leads, terminals and so on, as would be understood by one of ordinary skill.

Mount 101 is positioned across first conductor 13 and second conductor 15 such that front side 111 is generally orthogonal to central axis 17 of wire 10. Mount 101 is further placed such that bottom side 117 is in physical and electrical contact with wire 10. In embodiments, the first electrical contact of LED assembly 100 may be placed in connection with first conductor 13 and the second electrical contact of LED assembly 100 may be placed in connection with second electrical conductor 15. In embodiments, the first electrical contact may be placed in connection with the second electrical conductor 15 and the second electrical contact may be placed in connection with the first electrical conductor 13. In embodiments, two mounts 101 may be placed in gap 19 where back side 113 of first mount 101 of a first LED assembly 101*a* is adjacent to back side 113 of second mount 101 of a second LED assembly 101*b*, such that first LED assembly 101*a* is back-to-back with second LED assembly 101*b*, as depicted. In such an embodiment, first LED assembly 101*a* faces in a first direction D1 which is parallel to central axis 17, and emits light in the first direction D1; second LED assembly 101*b* faces in a second direction D2 which is parallel to central axis 17, and emits light in the second direction D2, the second direction D2 being opposite to the first direction D1. Light emitted in first direction D1 may be partially reflected or refracted on portions of insulation layer 11*a*, including portion 12*a*; light emitted in second direction D2 may be partially reflected or refracted on portions of insulation layer 11*b*, including portion 12*b*. Such reflection and/or refraction may create a unique lighting effect as compared to directing light in an upward or downward direction, such light not reflecting or refracting off of insulation layer 11.

In an embodiment, a spacing between back sides 113 of adjacent LED assemblies 101 may be approximately a thickness of mount 111. In other embodiments a spacing between assemblies 101 may be greater than the thickness of a mount 111. In an alternate embodiment, assemblies 101 may be located such that a portion of one LED assembly 101 physically contacts a portion of another LED assembly 101.

One skilled in the art will recognize that a variety of lighting effects may be achieved by varying the polarity to a plurality of LED assemblies 100 disposed along an axial length of wire 10. For example, in the embodiment depicted in FIG. 3, LED assembly 101*a* is connected with an electrical polarity that is opposite to LED assembly 101*b*. In such an embodiment, for a first voltage polarity between conductors 13 and 15, e.g., 13 is positive, 15 is negative, only LED assembly 101*a* will emit light due to a positive bias; for a second voltage polarity between conductors 13 and 15, e.g., conductor 15 is positive and conductor 13 is negative, only assembly 101*b* will emit light. In such an embodiment, a voltage polarity between conductors 13 and 15 may be switched to select which of LED assemblies 101 will be turned on and emit light. This may be particularly useful if adjacent LED assemblies 101 emit light of different colors, e.g., LED assembly 101*a* is red, and LED assembly 101*b* is green, such that switching the polarity switches the color of the light emitted. In such an embodiment, the light string might also include an optional controller or control device, with a processor and power electronics, to control voltage switching.

Figure 5:
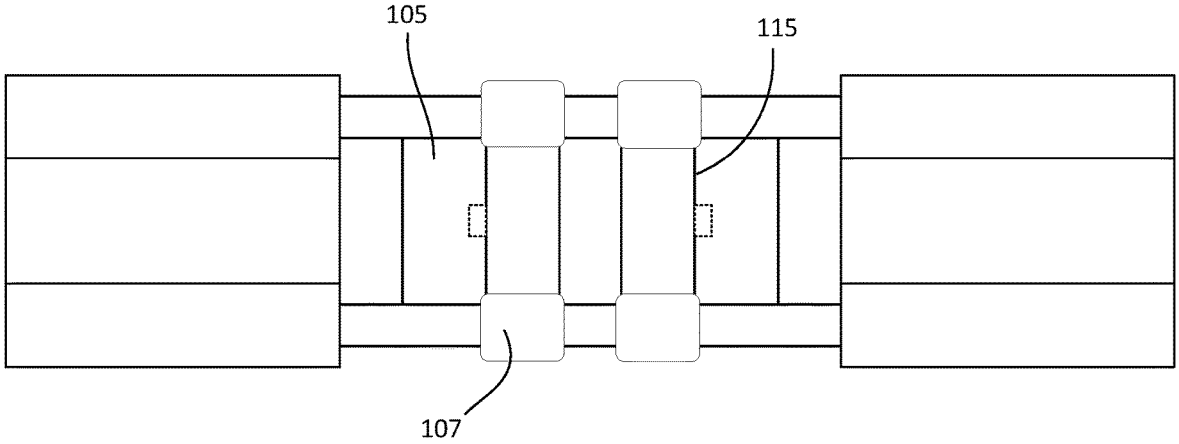
FIG. 5 is a bottom view of a wire with a plurality of LED assemblies according to an embodiment of the disclosure.

Mount 101 may be joined to wire 10 through the use of solder 107. Molten solder 107 applied near the intersection of the top side 115 and left side 119 of mount 101 will flow down left side 119 towards wire 10. Molten solder 107 applied near the intersection of the top side 115 and right side 121 of mount 101 will flow down right side 121 towards wire 10. Upon reaching first and second conductors 13, 19, molten solder 107 will flow around each of the two conductors 15, 19. In embodiments, solder 107 may substantially cover left side 119 of mount 101. In embodiments, solder 107 may substantially cover right side 121 of mount. As illustrated in FIG. 5, in embodiments, solder 107 may cover portions of first and second conductors 13, 19.

In embodiments, solder 107 may also flow over, or otherwise contact a portion of front side 111. In one such embodiment, the first and second electrical contacts may be positioned partially or fully on front side 111. Alternatively, solder 107 and/or the electrical contacts may be positioned partially or fully on back side 113.

Figure 6:
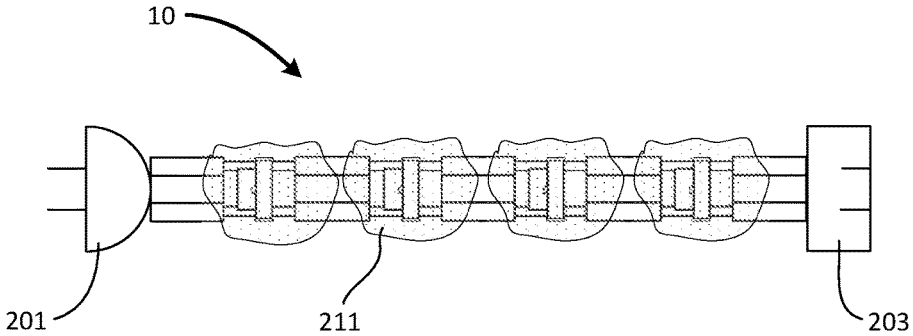
FIG. 6 is a top view of a wire according to embodiments of the disclosure.

As depicted in FIG. 6, wire 10 may include power plug 201 at a first end and receptacle 203 at a second end. In embodiments, power plug 201 may be configured to be directly attached to a power source. In embodiments, two or more wires 10 may be joined such that plug 201 of a second wire 10 is inserted into receptacle 203 of a first wire 10. Extending wire 10 in this manner allows a user more flexibility in achieving desired lighting effects.

Gaps 19 and LED assemblies 100 may be encapsulated in a protective layer 211. In embodiments, protective layer 211 may be translucent. In embodiments, protective layer 211 may be a non-conductive material. In embodiments, protective layer 211 is flexible. In an embodiment, protective layer 211 may comprise an ultraviolet (UV) adhesive that hardens or cures when exposed to UV light.

Figure 7:
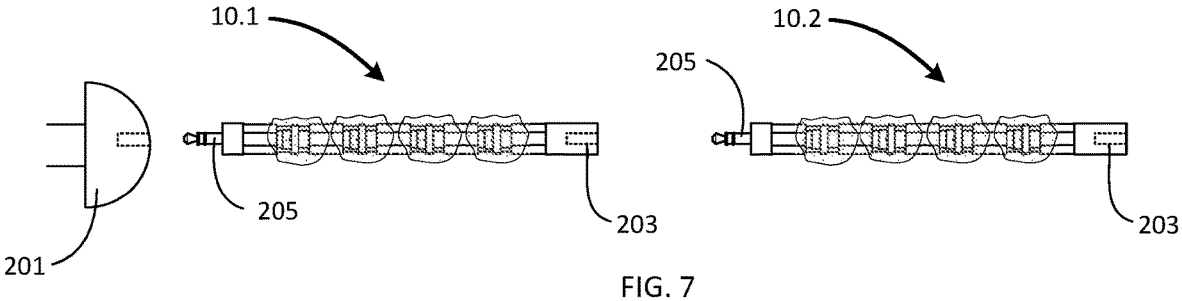
FIG. 7 is a top view of a plurality of wires and a power plug according to embodiments of the disclosure.

Referring to FIG. 7, wire 10 may include a coaxial terminal or contact set 205. In embodiments, power plug 201 may be configured to receive coaxial terminal or contact set 205. In embodiments, coaxial terminal or contact set 205 makes an electric connection with power plug 201, such that when power plug 201 is connected to a power source, power is transmitted to wire 10. In embodiments, receptacle 203 may be configured to receive coaxial terminal or contact set 205. For example, receptacle 203 of wire 10.1 may receive coaxial terminal or contact set of wire 10.2, such that power received by wire 10.1 may be transmitted to wire 10.2.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

What is claimed is:

1. A light string comprising:

a wire set comprising:

a first conductor in parallel with a second conductor such that an interior edge of the first conductor and an interior edge of the second conductor defines a space there between; and an insulation layer, wherein the insulation layer encapsulates a portion of the first conductor, a portion of the second conductor, and a space therebetween, the insulation layer defining a plurality of gaps such that portions of the first and second conductors are uninsulated; and a first plurality of LED assemblies, each of the first plurality of LED assemblies comprising:

a base having front, back, left, right, top, and bottom sides;

an LED electrically mounted to the front side of the base; and a lens cover affixed to the front side of the base and covering the LED, wherein a first conductive terminal of the bottom of the base is in electrical contact with the first conductor of the wire, and a second conductive terminal of the bottom of the base is in electrical contact with the second conductor of the wire, and a first solder portion encapsulates a portion of the left side of the base, the first conductive terminal, and a portion of the first conductor, and a second solder portion encapsulates a portion of the right side of the base, the right conductive terminal, and a portion of the second conductor.

2. The light string of claim 1, wherein the wire comprises a second plurality of LED assemblies wherein a first conductive terminal of the bottom of the base is in electrical contact with the second conductor of the wire, and a second conductive terminal of the bottom of the base is in electrical contact with the first conductor of the wire.

3. The light string of claim 2, wherein each of the first plurality of LED assemblies are positioned to direct light having a first color in a first direction, and each of the second plurality of LED assemblies are positioned to direct light having a second color in a second direction, the first color being different from the second color and the first direction being different from the second direction.

4. The light string of claim 3, wherein the first direction is opposite the second direction.

5. The light string of claim 3, wherein the first direction and the second direction are parallel to a lengthwise, central axis of the light string.

6. A method of making the light string of claim 5, comprising soldering the first plurality of LED assemblies to the wire set such that LEDs of the first plurality of LED assemblies faces the first direction and soldering the second plurality of LED assemblies to the wire set such that the second plurality of LED assemblies faces the second direction.

7. The light string of claim 1, wherein the wire set is configured to attached to a power plug.

8. The light string of claim 1, wherein the wire comprises a receptacle configured to receive a power plug.

9. The light string of claim 1, wherein the wire comprises a plurality of protective layers, wherein each of the protective layers encapsulates a gap and a LED assembly.

10. The light string of claim 1, wherein the base extends radially outward a distance greater than the radial distance of an exterior edge of the first conductor, the exterior edge being opposite the interior edge.

11. The light string of claim 1, wherein the base extends radially outward a distance greater than the radial distance of an exterior edge of the second conductor, the exterior edge being opposite the interior edge.

12. The light string of claim 1, wherein the lens cover extends radially outward a distance greater than the radial distance of the interior edge of the first conductor.

13. The light string of claim 1, wherein the lens cover extends radially outward a distance greater than the radial distance of the interior edge of the second conductor.

14. The light string of claim 1, wherein each of the plurality of LED assemblies comprises a plurality of LEDs.

15. The light string of claim 1, wherein each of the plurality of the LED assemblies is configured to produce a single color of light.

16. The light string of claim 1, wherein each of the plurality of the LED assembly is configured to produce multiple colors of light.

17. A light string defining a lengthwise, central axis, comprising:

a wire set comprising:

a first conductor in parallel with a second conductor; and an insulation layer, wherein the insulation layer encapsulates a portion of the first conductor, a portion of the second conductor, and a space therebetween, the insulation layer defining a plurality of gaps such that portions of the first and second conductors are uninsulated; and a first plurality of LED assemblies in electrical connection with the wire set, each of the first plurality of LED assemblies comprising:

a base portion;

an LED connected to the base portion and configured to emit light of a first color in a first direction; and a second plurality of LED assemblies in electrical connection with the wire set, each of the second plurality of LED assemblies comprising:

a base portion;

an LED connected to the base portion and configured to emit light of a second color in a second direction, the second direction being opposite to the first direction.

18. The light string of claim 17, wherein the first direction and the second direction are both parallel to the lengthwise, central axis of the light string.

19. The light string of claim 17, wherein each of the first plurality of LED assemblies is electrically connected to the wire set in a first electrical polarity configuration, and each of the second plurality of LED assemblies is electrically connected to the wire set in a second electrical polarity configuration, the first electrical polarity configuration being opposite to the first electrical polarity configuration.

20. The light string of claim 19, wherein the base portions of the first and second plurality of LED assemblies are mounted on a top portion of first and second conductors of the wire set, the top portion facing in a direction orthogonal to the lengthwise, central axis.

* * * * *